United States Patent [19]

Stewart

[11] 4,160,419

[45] Jul. 10, 1979

[54] TAMPING TOOL

[75] Inventor: John K. Stewart, Lexington, S.C.

[73] Assignee: Canron, Inc., New York, N.Y.

[21] Appl. No.: 842,335

[22] Filed: Oct. 14, 1977

[51] Int. Cl.[2] ..... E01B 27/13

[52] U.S. Cl. ..... 104/10; 172/719

[58] Field of Search ..... 104/1 R, 7 R, 7 A, 7 B, 104/8, 10, 11, 12, 13, 14; 37/142 R; 172/719

[56] References Cited

U.S. PATENT DOCUMENTS 4,062,291 12/1977 Vick et al. ..... 104/10

FOREIGN PATENT DOCUMENTS 734478 8/1955 United Kingdom ..... 104/10

*Primary Examiner*—Francis S. Husar
*Assistant Examiner*—Randolph A. Reese
*Attorney, Agent, or Firm*—Wenderoth, Lind & Ponack

[57] ABSTRACT

A railway ballast tamping tool is disclosed which has a foot welded to the lower end of a shank. The foot has rectangular front and rear faces and is gradually tapered from one side to the other.

2 Claims, 3 Drawing Figures

TAMPING TOOL

BACKGROUND OF THE INVENTION

This invention relates to railway ballast tamping tools.

Tamping machines for tamping ballast in railroad beds have a plurality of tamping tools which are arranged in pairs, with the tools in each pair being mounted for oscillation about a common axis centrally of the pair. Such tools, of course, wear rapidly in use and it is an object of the present invention to provide a tamping tool which will have an extended life compared with known tools.

SUMMARY OF THE INVENTION

The invention lies in a tamping tool comprising a shank and a foot mounted on the lower end of said shank, said foot having side edges spaced from said shank, one of said side edges being of greater thickness than the other.

Preferably, the foot has front and rear faces of rectangular shape and upper and lower faces which taper gradually from said one side edge to said other side edge.

By using the tamping tools of the invention in pairs in a tamping machine, with the feet in each pair having their thicker side edges remote from the axis of oscillation of the pair, the parts of the tools subject to most wear are adapted for longer life and hence the tools themselves are adapted for longer life.

DETAILED DESCRIPTION OF PREFERRED EMBODIMENT

Figure 1:
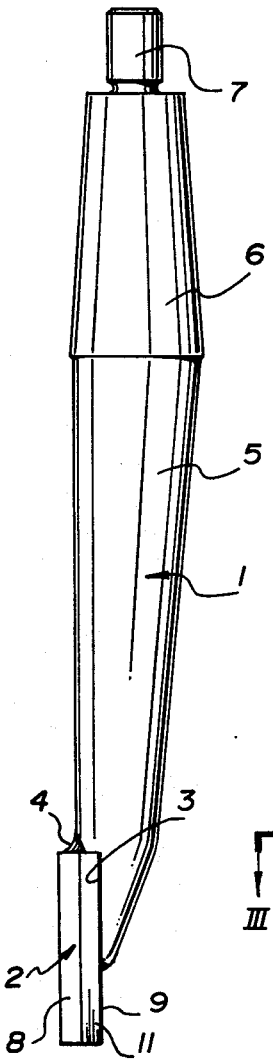
FIG. 1 is a side elevational view of a tool embodying the invention.
Figure 2:
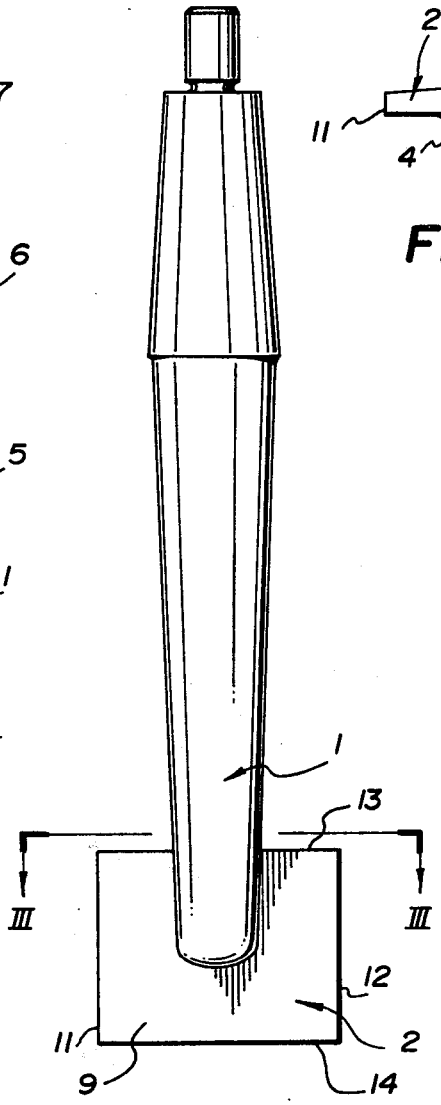
FIG. 2 is a rear elevational view of the tool shown in FIG. 1.

The tool shown in the drawings has a shank 1 and a foot 2, the central upper part of the foot engaging in an L-shaped recess 3 at the lower end of the shank and the shank and foot being welded together at 4. The cooling of the weld forces the facing surfaces of shank and foot into a shrink type contact to allow direct transmission of forces between the shank and the foot.

The shank has a downwardly tapering lower part 5, an upwardly tapering upper part 6 and a threaded stud 7 centrally disposed on top of the part 6 for mounting the tool in a tamping machine.

Figure 3:
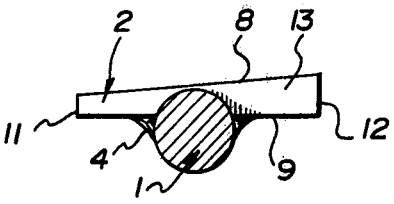
FIG. 3 is a sectional view taken on the line III-III of FIG. 2.

The foot has rectangular front and rear surfaces 8 and 9, rectangular side surfaces 11 and 12 and upper and lower surfaces 13 and 14 which taper gradually from one end thereof to the other as clearly shown in FIG. 3. The result is that one side edge of the foot is thicker than the other and is therefore able to sustain a greater amount of wear. In FIG. 3 the taper is shown as running from right to left and, of course, that tool would form a pair with a similar tool in which the taper runs from left to right so that the thicker edges would be remote from each other in use.

What I claim as my invention is:

1. A tamping tool comprising a shank and a foot mounted on the lower end of said shank, said foot having a planar front face, a rear face, upper and lower faces and side edges spaced from said shank, one of said side edges being of greater thickness than the other and said upper and lower faces tapering gradually from said one side edge to said other side edge, whereby said tool is adapted for longer life.

2. A tamping tool as claimed in claim 1, wherein the lower end of the shank has an L-shaped recess therein and the top of the foot is partly received in said recess and the shank and foot are welded together.

* * * * *